US005431353A

United States Patent [19]

Horler

[11] Patent Number: 5,431,353

[45] Date of Patent: Jul. 11, 1995

[54] BOBBIN WINDING MACHINE

[75] Inventor: Beat Horler, Elgg, Switzerland

[73] Assignee: Maschinenfabrik Rieter AG, Winterthur, Switzerland

[21] Appl. No.: 67,051

[22] Filed: May 13, 1993

[30] Foreign Application Priority Data

May 18, 1992 [CH] Switzerland ..... 01604/92

[51] Int. Cl.[6] ..... B65H 67/048

[52] U.S. Cl. ..... 242/18 A

[58] Field of Search ..... 242/18 A, 25 A

[56] References Cited

U.S. PATENT DOCUMENTS 4,598,876 7/1986 Schefer ..... 242/18 A
4,613,090 9/1986 Sugioka ..... 242/18 A
4,709,866 12/1987 Schefer ..... 242/18 A
4,948,058 8/1990 Behrens et al. ..... 242/18 A
4,969,607 11/1990 Busenhart et al. ..... 242/18 A
5,102,060 4/1992 Busenhart ..... 242/18 A
5,156,347 10/1992 Gay, II et al. ..... 242/18 A
5,318,232 6/1994 Busenhart et al. ..... 242/18 A

*Primary Examiner*—Daniel P. Stodola
*Attorney, Agent, or Firm*—Burns, Doane, Swecker & Mathis

[57] ABSTRACT

A separating apparatus mounted on the casing of a bobbin winding machine includes a pivotable separating support having upper leg on which separating flaps are swivellably attached. After the rotation of the revolver during a change of the bobbins, the support is pivoted and the separating flaps are moved to position portions of the flaps between the full bobbin and the newly supplied empty bobbin on which yarn is then being wound. In this position the separating flaps prevent the loose whizzing yarn end on the yarn on the still rotating full bobbin from coming into contact with the yarn package then in the process of being wound.

20 Claims, 5 Drawing Sheets

BOBBIN WINDING MACHINE

FIELD OF THE INVENTION

The invention relates to bobbin winding machines for handling yarns. It is concerned more particularly with winders of the type wherein, as one bobbin becomes full, its position is taken by an empty bobbin, with the incoming yarn to be wound being led onto the new bobbin automatically and severed from connection with the just completed full bobbin to leave a loose end at the surface of the completed yarn package.

BACKGROUND OF THE INVENTION

In modern high-performance automatic bobbin winders, the change of bobbins is carried out without interrupting the supply of yarn. In a known bobbin winding machine such as that disclosed in U.S. Pat. No. 4,969,607 (corresponding to Swiss Patent Application No. CH-A-677781), two rotatable pegs or spindles are mounted on a revolver or turret, and holders for the bobbins may be attached to such spindles. After a predefinable yarn quantity is wound on a bobbin on one of the spindles, that spindle is removed from the winding position to a changing or standby position by a partial rotation of the revolver. During the rotation of the revolver, the empty bobbin on the second spindle reaches the winding position.

During this process, the incoming yarn to be wound is still supplied continuously. The yarn leading to the full bobbin is deflected to yarn catching and severing means, such as a slot on the empty bobbin provided with a knife or cutter, by means of yarn changer apparatus which can be pivoted from the side between the empty bobbin and the full bobbin, so that said yarn is grasped by the yarn catcher knife and separated. The separated end on the full bobbin, which continues to rotate after the separation due to its inertia, beats on the driven empty bobbin (now in the winding position) during each rotation. This leads to the danger that the loosely whizzing yarn end could get entangled with the yarn supplied to the now empty bobbin.

In order to prevent this, separating means may be introduced from the side of the bobbin away from the yarn changer apparatus into the area of the surface of the full bobbin in order to prevent the projecting whizzing yarn end from coming into contact with the empty bobbin. In order to carry out the protection effectively, the separating apparatus must be of a certain dimension. This, however, leads to the effect that a lot of space is required to bring the separating apparatus, when it is not required, into a position where it will not interfere with the desired building and moving of the yarn packages, since the separating means must be kept outside of the bobbin being built up and outside of the already full bobbin pivoting with the revolver during the change of the bobbin.

SUMMARY OF THE INVENTION

According to the present invention, a bobbin winding machine is provided with separating apparatus that can be used effectively to control the loose end of yarn from a still rotating full yarn package that has been shifted away from the winding station but can be installed in a small space. When the separating apparatus is not in use, it can be configured to lie within a machine width that is determined by the full bobbin.

A preferred separating apparatus features a plurality of somewhat elongated separating flaps or shields that are pivoted for swinging movements from withdrawn positions to active positions. In their withdrawn positions, the flaps are aligned with an end portion of one flap partially overlapping the opposite end portion of the next flap, and so on to form a row of flaps located to one side of the assembly containing the spindles and extending general parallel to the spindle axes. In reaching their active positions, the flaps swing through about 90 degrees to project into the space between the two spindles to effectively restrain the loose yarn and from whipping against the new yarn package.

Preferably, the whole supporting structure for the separating support with the swivellable separation flaps attached thereto is arranged in the smallest possible space, i.e., an area which is not passed by the full bobbin during the pivoting movement and through which the still empty bobbin is not guided. The separating flaps which swivel out come to lie above the surface of the full bobbin after the turret has been revolved to position the full bobbin at its removal or standby station, so that the swinging loose yarn end projecting from the surface of the full bobbin can be kept guided near the bobbin surface. The separating apparatus can be designed for any desired number of bobbins attached to a spindle and the separating flaps can be retracted in a simple manner during the build-up of the bobbin to occupy the smallest possible space. For actuating the separating apparatus it is only required to swing out the support carrying the separating flaps and to swivel the separating flaps out of the support.

BRIEF DESCRIPTION OF THE DRAWINGS

The invention is described below in greater detail by reference to the accompanying drawings, in which.

DETAILED DESCRIPTION OF THE PREFERRED EMBODIMENT

Figure 1:
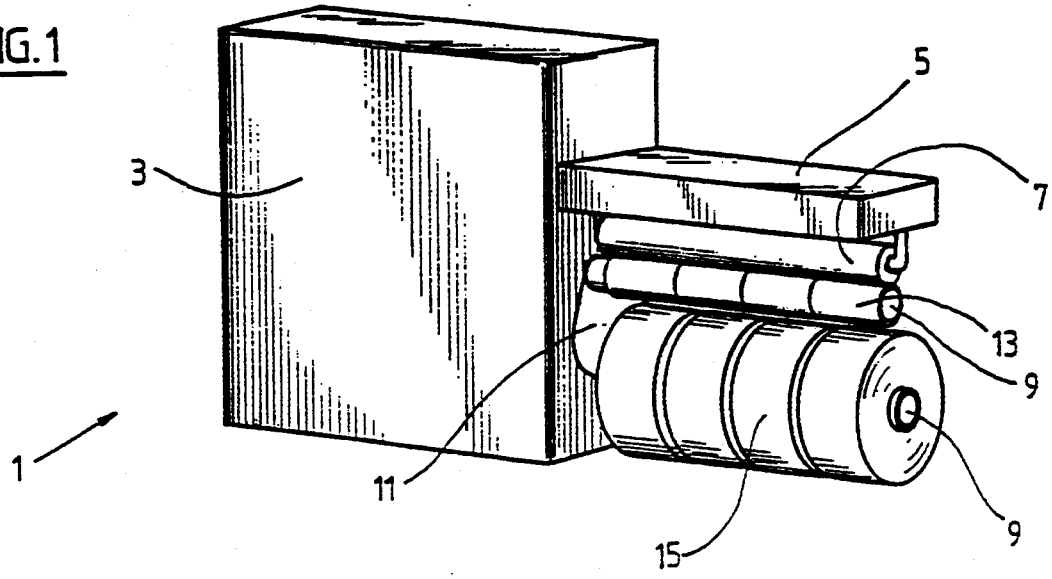
FIG. 1 shows a schematic representation of a bobbin winding machine with a revolver carrying empty bobbins and full bobbins, but with the separating apparatus being omitted.

The bobbin winding machine 1 shown in FIG. 1 includes a machine casing 3 and a carrier arm 5 which projects forwardly therefrom. A rotatable pressure roller 7, sometimes called a tacho-roll or tachometer roller, is connected to the carrier arm 5. A turret or revolver 11 is mounted for revolution (in a clockwise direction in FIGS. 1–6) about a horizontal axis (indicated by "x" in FIG. 2) extending out of the main machine casing 3.

The turret 11 supports two pegs or spindles 9 for rotation about horizontal axes located on opposite sides of the axis of revolution of the turret 11. On the upper peg 9 there are four empty bobbins 13 in FIG. 1. On the lower peg 9 there are four full bobbins 15. This is representative of a situation that would exist just after the turret had been revolved through 180 degrees to switch the positions of the bobbins on the upper and lower sides of the axis of the turret and before the winding of yarn onto the new empty bobbin 13 had been begun.

It will be understood that the upper spindle position in FIG. 1 is the winding position. Yarn will be wound on the bobbins on this upper spindle to build yarn packages that are continuously in surface contact with the pressure roll 7. When the yarn packages reach the desired full state, the turret is activated to swing the full spindle to the lower position from which the full yarn packages will ultimately be removed from the machine, after the rotation of the lower spindle has stopped at a time that is suitable from the standpoint of other operations in the facility. Then new empty bobbins will be installed on the lower spindle to ready it for the next change operation.

Some elements associated with the bobbin changing process have been left out in FIG. 1 in order to provide improved clarity. They will be shown in the following Figures, provided that they are required for understanding the invention.

Figure 2:
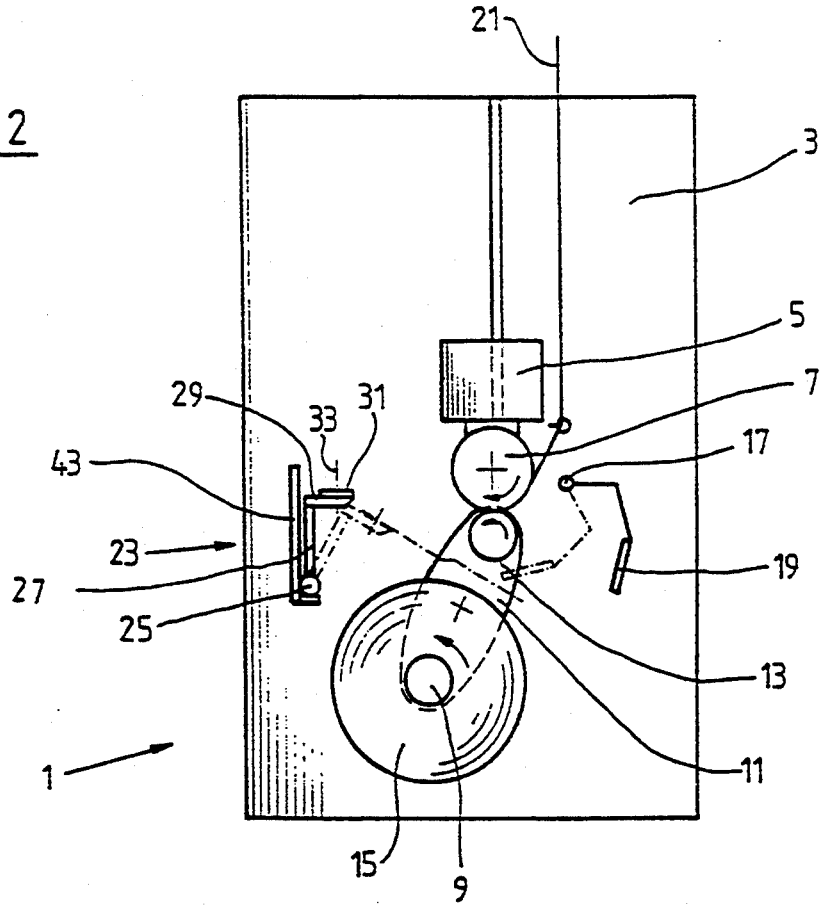
FIG. 2 shows a schematic representation of a front view of a bobbin winding machine like the one in FIG. 1 but with separating apparatus in accordance with the present invention installed thereon.

A yarn changer apparatus 19 is swivellable about an axis 17 as schematically shown on the right-hand side of the tachometer roller in FIG. 2. An example of such an embodiment of such a changer apparatus is known from U.S. Pat. No. 5,102,060 (corresponding to European Patent EP-A1-0410926). It is used to guide the yarn 21 running from above to the bobbin winder 1. This yarn 21 continues for a time to run to and wind onto the full bobbin 15 after the turret has rotated to swing the bobbin 15 downwardly clockwise. The changer 19 guides the yarn into a catcher slot or catcher knife at the end of the empty bobbin, so that the yarn is caught there and cut.

Figure 3:
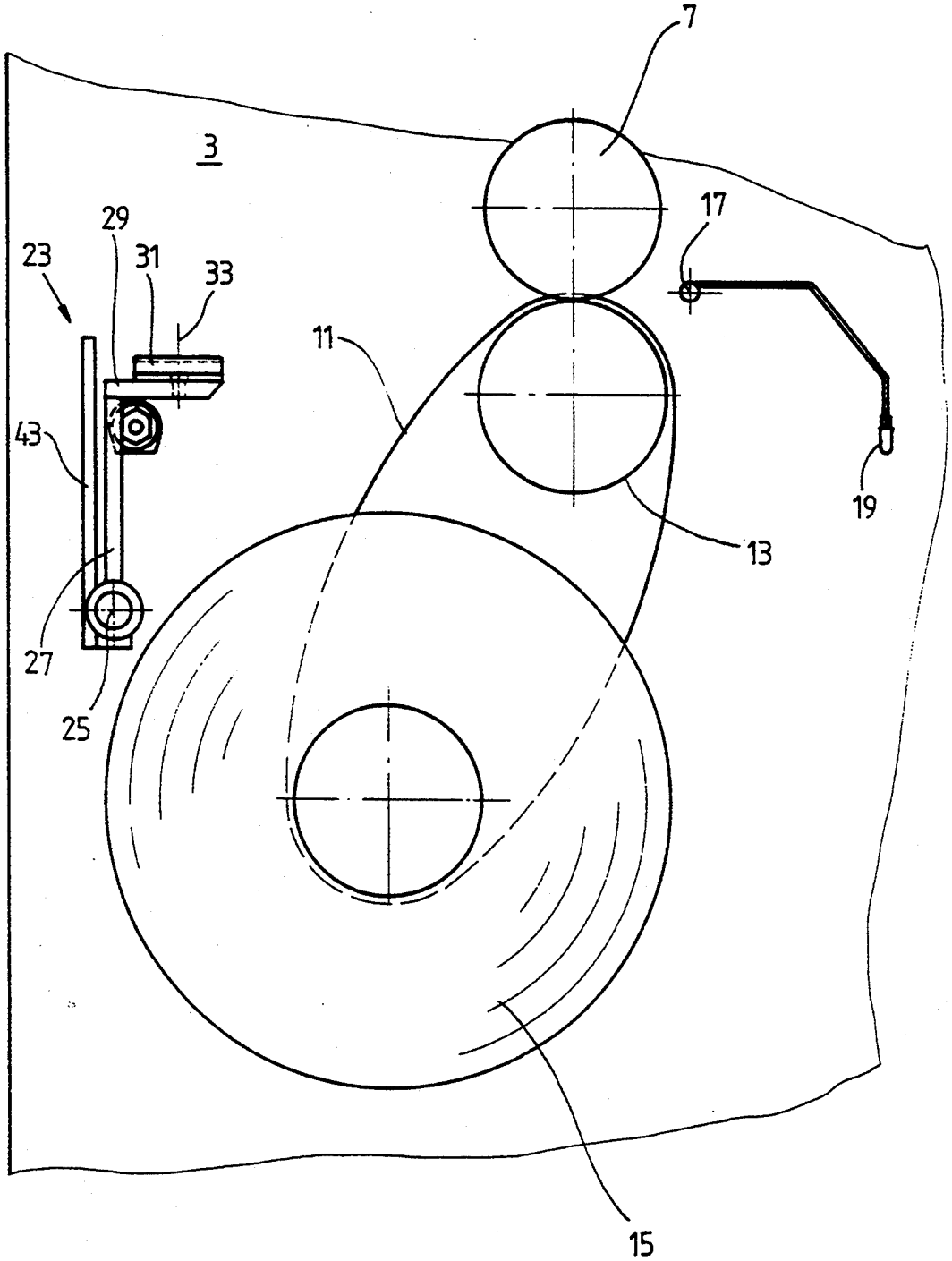
FIG. 3 shows an enlarged view of the portion of FIG. 2 representing a full bobbin, an empty bobbin and the separating apparatus in the idle position.

Spaced to the left (as viewed in FIGS. 2–6) of the empty bobbin in the winding position, there is a separating apparatus 23 which is swivellable about an axle 25 attached to casing 3. The separating apparatus 23 includes an L-shaped support 27 which is pivotable on axle 25. The upper leg 29 of the support is horizontal in the idle position shown in FIG. 3. A number of elongated shield members or separating flaps 31 are carried by the upper leg 29 of the support and mounted for swinging movement about the axis of vertical axles 33 located at end portions of the respective shields 31. The number of the shields 31 is equivalent to the number of the bobbin sleeves 13 on the peg 9. In FIG. 3 the separating apparatus 23 is in its idle position. When it is in this position, it offers no interference to rotation of the turret 11 to swing an empty bobbin clockwise (in FIG. 2) from a lower position to the upper position adjacent the pressure roll 7. During such movements, the moving parts move freely past all parts of the idle separating apparatus 23 shown in full lines in FIG. 2.

Figure 4:
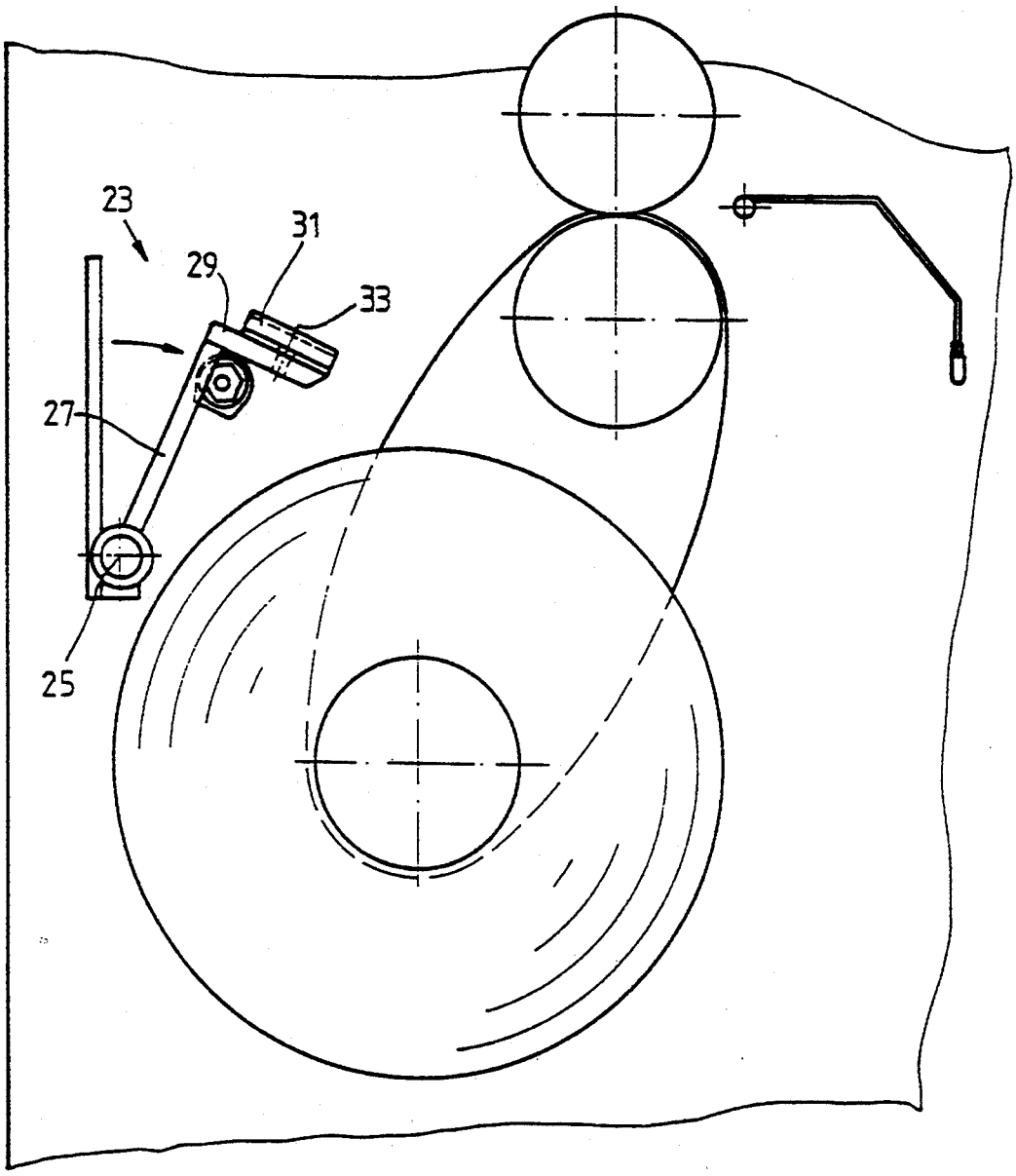
FIG. 4 shows a view similar to FIG. 3, but with the separating apparatus resting in an intermediate position.

FIG. 4 shows the separating support 27 of separating apparatus 23 swivelled by approximately 25 degrees. The leg of the support 27 that was vertical in FIG. 3 is now disposed at about the same inclination as a line joining the two diametrically opposed spindles 9 on the turret 11. The swivelling is brought about by a swivelling mechanism which will be outlined in greater detail below. The separating flaps 31 are still in the idle position and are arranged like bricks overlapping one another on the upper leg 29 of the separating support 27.

Figure 5:
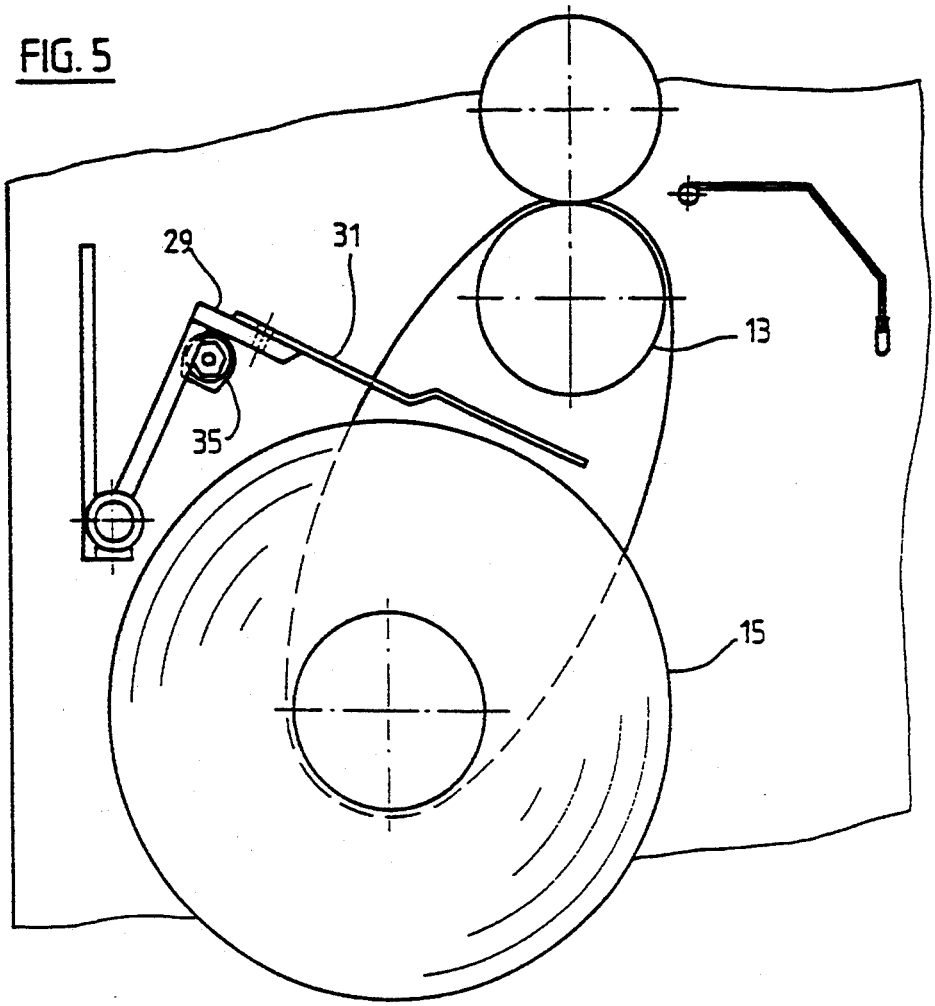
FIG. 5 shows a representation similar to FIGS. 3 and 4, but with the separating apparatus being swivelled out into the working position.

In the illustration in accordance with FIG. 5, the separating flaps 31 are shown to have been pivoted substantially 90 degrees about the axes 33 to active positions where they control any loose yarn end that may protrude from the still rotating surface of the full bobbin that has been shifted to its standby or "change" position at the lower portion of the machine. The flaps are brought to their active position (which is substantially perpendicular to the upper leg 29 of the support 27) from an idle position (which is substantially parallel to the upper leg 29 of the support 27) by a pneumatic cylinder, as will be explained below in greater detail. The separating flaps now project into the gap between the empty bobbin 13 and the full bobbin 15. The separating flaps are arranged here closer to the surface of the full bobbin 15 than to the surface of the empty bobbin 13, because instantly after the transfer of the continuously incoming yarn 21 of the full bobbin 15 to the empty bobbin 15, the empty bobbin's diameter begins to increase instantly. In its active position, each separating flap is located so as to overlie a portion of its respective full bobbin where the loose yarn end is located. For example, that location could constitute an end portion of the full bobbin where the yarn is being wound to form a so-called tail. Hence, each separating flap will lie between a respective loose yarn end and a respective empty bobbin 13.

Figure 6:
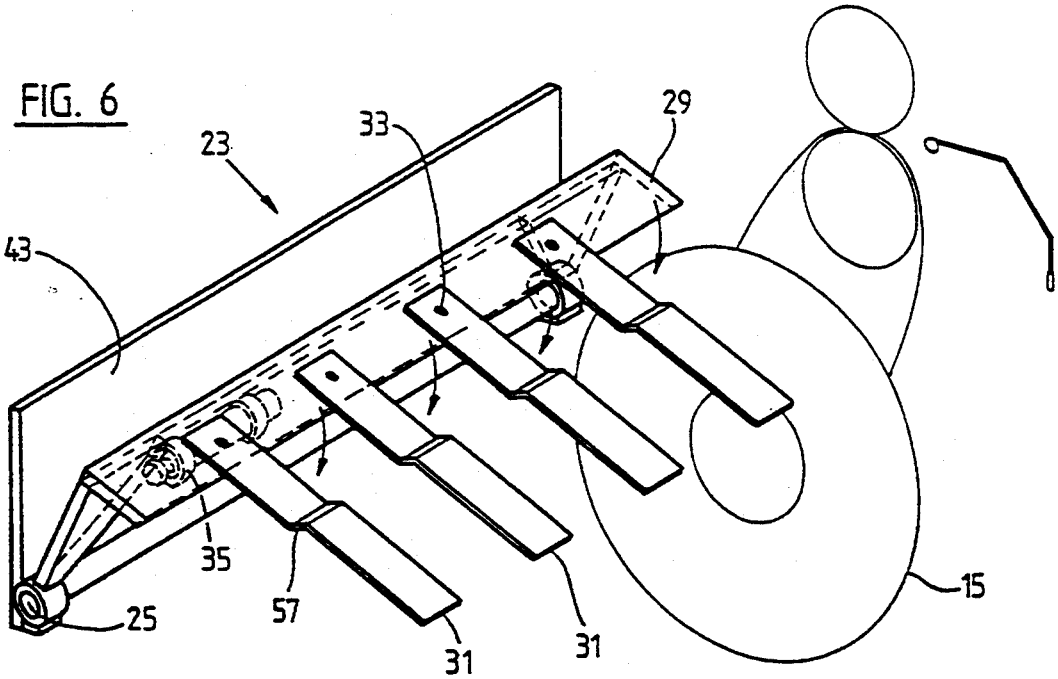
FIG. 6 shows a somewhat diagrammatic perspective representation of the arrangement in FIG. 5.

FIG. 6 also shows the four separating flaps in the active or operating position, with the full bobbin 15, the tachometer roller 7 and the empty bobbin 13 being schematically indicated by circles. The rear end portions of the flaps 31 and their pivotal mountings also have been simplified for this illustration.

Figure 7:
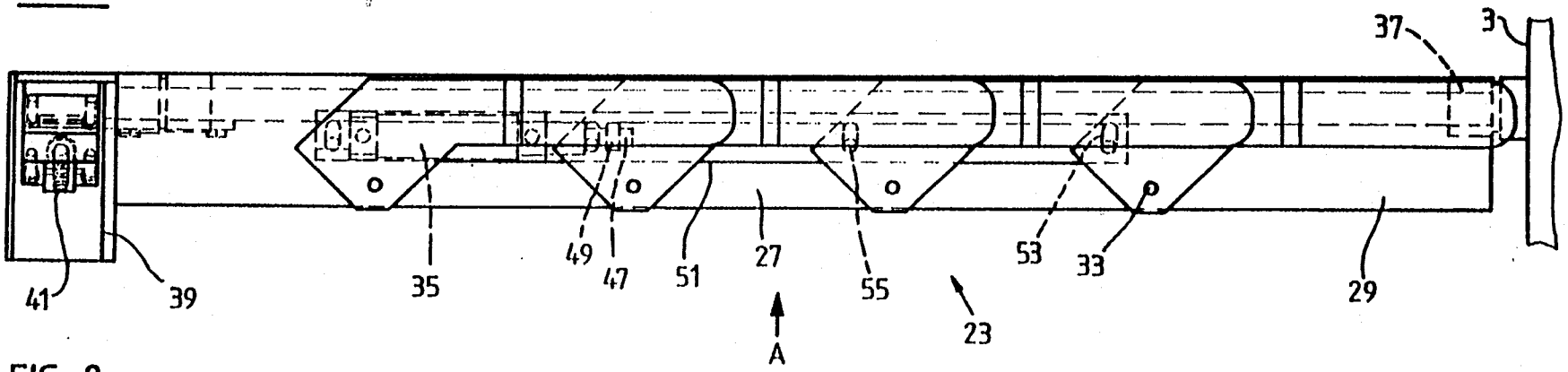
FIG. 7 shows a more detailed top view of the separating apparatus.
Figure 8:
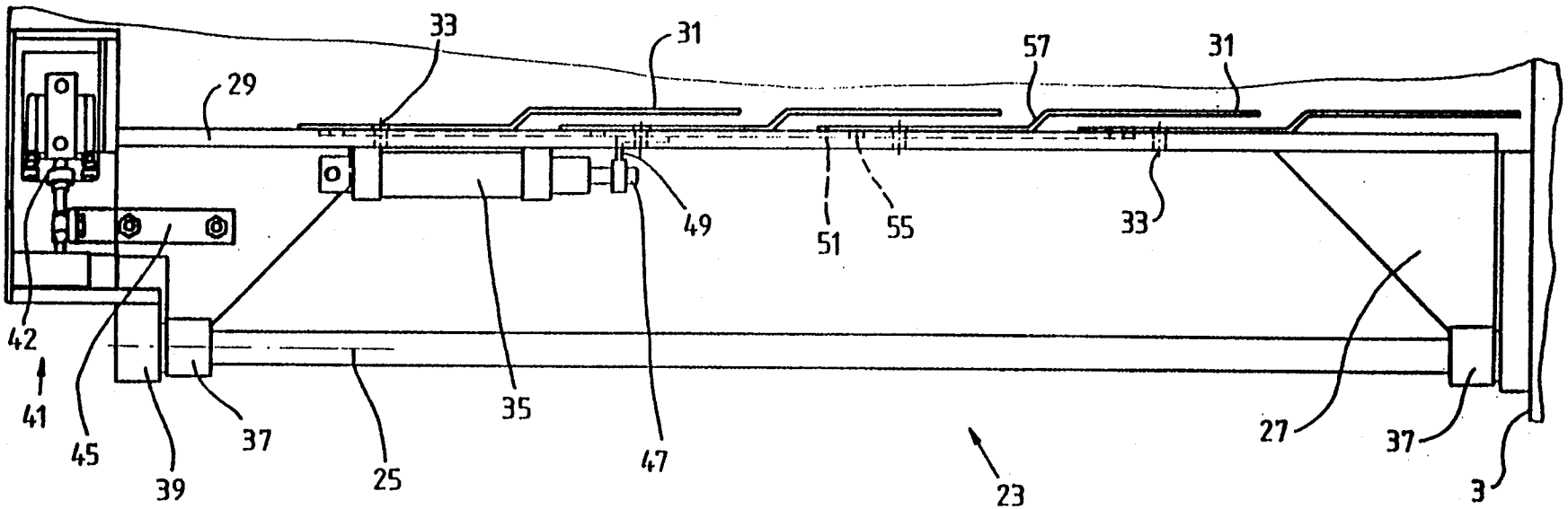
FIG. 8 shows a view of the separating apparatus as seen in the direction of the arrow (A) in FIG. 7.

The mechanical arrangement of the separating apparatus will now be explained in greater detail by reference to FIGS. 7 and 8. The L-shaped separating support 27 is swivellably held on the axle 25 by means of two bearing bushes 37. On the end of the swivelling axle 25 remote from the casing 3, a swivelling drive 41 is situated on a carrier 39, with respect to which the separating support 27 is swivellable about the axle 25. The swivelling drive 41 comprises of a pneumatic cylinder 42 acting between the rigid carrier element 43 attached to the machine casing 3 and the separating support 27. The connection with the separating support 27 is made via an L-shaped bracket 45. The swivelling drive allows the swivelling of the support 27 from the idle position in accordance with FIG. 3 to the operating or functional position in accordance with FIGS. 4 and 5.

A pneumatic cylinder-piston unit 35 for the swivelling drive of the separating flaps 31 is attached below the upper leg 29 of the separating support 27. The piston rod 47 of this cylinder-piston unit 35 is connected with a sliding plate 51 through a connecting member 49. Slots 53, which extend transversely to the direction of displacement, are provided in the sliding plate 51. Driving pins 55 project from the lower sides of the separating flaps 31 (to which they are rigidly attached) and engage into the slots 53.

The separating flaps 31 are provided with an angular area 57 (see FIG. 8) which allows arranging the separating flaps partly overlapping one another in the idle position.

The sliding plate 51 is longitudinally guided on the upper leg 29 by a groove (not shown) on the upper side of leg 29.

To swivel out the separating flaps 31, the piston rod 47 of the piston-cylinder arrangement 35 is extended. This displaces the sliding plate 51 in FIG. 7 to the right-hand side. The displacement of the sliding plate 51 causes the driving pins 55 to be pushed to the right. These pins 55 are situated at lateral distances from the swivelling axles 33 for their respective flaps or shields 31, so that movement of the pins 55 causes the flaps 33 to swivel about their vertical axles 33. The return swivelling is made in the opposite direction analogously. Obviously, the separating flaps can be arranged and provided in such a way that the swivelling is also possible in the opposite direction of rotation.

Alternatively to the pneumatic swivelling apparatus 35 it is naturally also possible to use a linear drive.

Although the present invention has been described in connection with a preferred embodiment thereof, it will be appreciated by those skilled in the art that additions, deletions, modifications and substitutions not specifically described may be made without departing from the spirit and scope of the invention as defined in the appended claims.

What is claimed is:

1. Bobbin winding machine for winding incoming yarn on a bobbin, comprising a rotatable revolver having two pegs for receiving empty bobbins, a changer apparatus for transferring the incoming yarn from a full bobbin to a new empty bobbin with a loose yarn end extending from the full bobbin, said changer apparatus being insertably arranged between the full bobbin swivelling away from a winding position toward a doffing position and the new bobbin swivelling towards the winding position, and a separating apparatus for keeping the loose yarn end on the full bobbin away from the new bobbin, said separating apparatus being arranged on a side of the new bobbin located at the winding position which is opposite the changer apparatus, the separating apparatus including swivellable separating flaps which are movable from an idle position in which portions of adjacent flaps overlie one another to a working position in which the flaps are located between the full bobbin located in the doffing position and the new bobbin located in the winding position.

2. Bobbin winding :machine as claimed in claim 1, wherein the separating flaps are carried by a separating support, and including a linear drive positioned on the separating support and connected to a sliding plate which is guided on the separating support, said plate being connected with the separating flaps so that operation of the linear drive results in movement of the separating flaps from the idle position to the working position.

3. Bobbin winding machine as claimed in claim 2, wherein the separating support includes an upper leg the separating flaps being swivellably held on the upper leg of the separating support through swivelling axles.

4. Bobbin winding machine as claimed in claim 3, including driving pins attached to the sliding plate and slots located in the separating flaps, the driving pins being positioned in the slots of the separating flaps.

5. Bobbin winding machine as claimed in claim 4, wherein each separating flap is movable from the idle position to the working position by swivelling about an axis that is disposed at a lateral distance from a central line of the separating flaps.

6. Bobbin winding machine as claimed in claim 5, wherein the slots in the separating flaps are arranged vertically with respect to the direction of displacement of the sliding plate when the separating flaps are in the idle position.

7. Bobbin winding machine as claimed in claim 1, wherein the separating flaps are carried by a separating support which is swivellable about an axis extending parallel to the pegs.

8. Bobbin winding machine as claimed in claim 7, including a linear drive positioned on the separating support and connected to a displaceable sliding plate which is positioned on the separating support, said plate being connected with the separating flaps so that operation of the linear drive results in movement of the separating flaps from the idle position to the working position.

9. Bobbin winding machine as claimed in claim 8, including driving pins attached to the sliding plate and slots located in the separating flaps, the driving pins being located in the slots of the separating flaps, the slots in the separating flaps being arranged vertically with respect to the direction of displacement of the sliding plate when the separating flaps are in the idle position.

10. Bobbin winding machine as claimed in claim 7, wherein the separating support includes an upper leg the separating flaps being swivellably mounted on the upper leg of the separating support through swivelling axles.

11. Bobbin winding machine as claimed in claim 10, including a linear drive positioned on the separating support and connected to a sliding plate guided on the separating support, said sliding plate being connected with the separating flaps.

12. Bobbin winding machine as claimed in claim 11, including driving pins attached to the sliding plate and slots located in the separating flaps, the driving pins being positioned in the slots of the separating flaps.

13. Bobbin winding machine as claimed in claim 12, wherein the slots in the separating flaps are arranged vertically with respect to the direction of displacement of the sliding plate when the separating flaps are in the idle position.

14. Bobbin winding machine as claimed in claim 13, wherein the swivelling axles are disposed at a lateral distance from a central line of the separating flaps.

15. Bobbin winding machine as claimed in claim 14, wherein the separating flaps each comprise a length of sheet metal which is bent at two spaced apart locations.

16. Bobbin winding machine as claimed in claim 12, wherein the swivelling axles are disposed at a lateral distance from a central line of the separating flaps.

17. Bobbin winding machine as claimed in claim 1, wherein the separating flaps each comprise a length of sheet metal which is bent at two spaced apart locations.

18. In a winder of a type in which a first spindle rotatable about a rotational axis is moved away from a winding position to a standby position when a yarn package thereon has become full, a second spindle rotatable about a rotational axis is moved into the winding position, and incoming thread to be wound is attached to a new empty yarn package on the second spindle and is severed from the full yarn package on said first spindle to leave a loose yarn end protruding from the surface of the still rotating full yarn package at said standby position, with a space being located between the full yarn package and the new yarn package, the improvement comprising a plurality of elongated shield members each having opposite ends, each shield member being pivoted near one of its ends for swinging movement about a pivot axis, said pivot axes being laterally spaced apart from one another in a direction generally parallel to the rotational axes of said first and second spindles, and means for swinging all of said shield members between a first inactive position in which said shield members are disposed in endwise overlapping relation to one another at a location away from the space between the full and new yarn packages and a second active position in which said shield members protrude into the space between the full and new yarn packages to keep the loose yarn end on the still rotating full yarn package away from the new yarn package being wound.

19. The invention according to claim 18, wherein said elongated shield members are mounted on a movable support and wherein said means for swinging includes a linear drive, and including means for moving said support to shift said shield members toward and away from the space between said full and new yarn packages.

20. The invention according to claim 19, wherein said support is pivotally mounted for movement about an axis generally parallel to said spindles at a location laterally beyond a path of movement of the new yarn package from said standby position to said winding position.

* * * * *